United States Patent [19]

DeRemer

[11] 4,277,659

[45] Jul. 7, 1981

[54] POWER INTERLOCK SWITCH FOR ELECTRICAL APPLIANCES

[75] Inventor: Harold A. DeRemer, Allentown, Pa.

[73] Assignee: General Electric Company, New York, N.Y.

[21] Appl. No.: 1,452

[22] Filed: Jan. 8, 1979

[51] Int. Cl.[3] ..... H01H 3/16

[52] U.S. Cl. ..... 200/61.62; 99/337; 219/521

[58] Field of Search ..... 99/337, 338; 200/50 A, 200/61.62, 61.76–61.82, 164 R; 219/507; 361/357

[56] References Cited

U.S. PATENT DOCUMENTS

| | | | |
|---|---|---|---|
| 1,680,732 | 8/1928 | De Tar | 200/61.81 |
| 1,725,441 | 8/1929 | Caldwell | 200/50 A |
| 2,548,034 | 4/1951 | Major | 200/61.74 X |
| 2,611,067 | 9/1952 | Kennedy | 200/61.81 X |
| 2,717,933 | 9/1955 | Carden | 200/61.82 |
| 2,743,351 | 4/1956 | Gorham | 263/394 |
| 2,986,991 | 6/1961 | Yetter | 200/50 A X |
| 3,187,130 | 6/1965 | Bye et al. | 200/164 R X |
| 3,289,917 | 12/1966 | Buchanan | 339/106 X |
| 3,700,846 | 10/1972 | Ishikawa et al. | 200/61.82 |
| 3,712,970 | 1/1973 | Adie | 200/164 R |
| 3,881,797 | 5/1975 | Grandinetti | 339/106 |
| 3,967,164 | 6/1976 | Valle | 200/61.62 X |

*Primary Examiner*—James R. Scott

*Attorney, Agent, or Firm*—Leonard J. Platt; George R. Powers; John F. Cullen

[57] ABSTRACT

A power interlock switch for an appliance having a removable panel, the power interlock switch comprising a base mounted to the housing, first and second switch terminals mounted to the base, a leaf spring conductor mounted to the first switch terminal and deflectable into contact with the second switch terminal, and a pivotally mounted lever which is engaged by the removable panel and rotates to deflect the leaf spring conductor into bridging contact across the two switch terminals. One conductor of the appliance line cord is connected to one of the switch terminals via a clip and tab structure, and the other switch terminal is connected to electrical components of the appliance. A third terminal mounted to the base has tabs for connecting the other conductor of the line cord and an additional conductor completing the circuit. A cover is provided and clamps the line cord to the base for strain relief purposes. When the removable panel is removed from the appliance, the leaf spring conductor separates from contact with the second switch terminal to cut off power to the electrical components of the appliance.

15 Claims, 9 Drawing Figures

POWER INTERLOCK SWITCH FOR ELECTRICAL APPLIANCES

BACKGROUND OF THE INVENTION

This invention relates to a power interlock switch well adapted for use in an electrical appliance having a removable panel to automatically switch off power to the appliance when the panel is removed.

Electrical appliances often contain electrical components which pose a hazard of electrical shock or burns to anyone touching them. Such electrical components are, therefore, to the extent practicable, positioned in compartments within the electrical appliances such that access to them is not readily available. In some instances, it is necessary to have exposed electrical components within electrical appliances, e.g. in electrical cooking appliances, electrical resistance heating elements are exposed within the cooking cavity in order to provide heat thereto. A toaster/oven is an example of one such electrical appliance, wherein there are both electrical components in the form of thermostats, controls, timers, etc., and there are also electrical resistance heating elements disposed in a cooking cavity.

In a copending application, Ser. No. 001,024 filed Jan. 4, 1979 now abandoned, also assigned to the assignee of this application, there is disclosed a toaster-/oven having a removable back panel. In conjunction with a pivotally opening door, also preferably removable, opposite the removable rear panel, access to the interior of the cooking cavity is greatly improved, and cleaning may be more readily accomplished. Despite the provision of a door switch for switching off electrical power to the heating elements of the toaster/oven when the door is opened, the removable rear panel provides additional access to the interior of the cooking cavity and to the heating elements therein. Thus, a door switch alone is insufficient to assure that there will be no electrical power to the heating elements during cleaning. In addition, the door switch does not cut off power to electrical components of the toaster/oven other than the heating elements.

Electrical appliances such as toaster/ovens need to be serviced from time to time, and in the instance of electrical cooking appliances, they need to be cleaned. It is desirable that the supply of electricity to an appliance be switched off during service and/or cleaning, and that the switching off of the electricity occur automatically upon the removal of panels which expose the dangerous electrical components.

SUMMARY OF THE INVENTION

It is a principal object of the invention herein to provide a power interlock switch for use in conjunction with an appliance having a removable panel wherein the panel maintains the power interlock switch in its closed position supplying power to the appliance, and upon removal of the panel, the power interlock switch automatically opens to cut off power to the appliance.

It is another object of the invention herein to provide a power interlock switch of the above type which achieves strain relief on the line cord leading to the appliance.

It is a further object of the invetion herein to provide a power interlock switch of the above type wherein the power interlock switch achieves a simple connection of the line cord to the appliance and further achieves a simple connection from the power interlock switch to the electrical components of the appliance.

It is an additional object of the invention herein to provide a power interlock switch which is easily mounted to a metal panel forming a wall of the housing of the appliance.

It is yet another object of the invention herein to provide a power interlock switch which is constructed of relatively few parts, is inexpensive to manufacture, and is rugged and reliable.

A power interlock switch for electrical appliances having a removable panel comprises a nonconductive base mounted to the appliance, the base having a surface disposed inside the appliance. Two switch terminals are mounted at spaced-apart locations on the interior base surface, one switch terminal being connected to one conductor of a line cord for the appliance and the other switch terminal being connected to a conductor for supplying power to the electrical components within the electrical appliance. A second conductor of the line cord is connected to complete a circuit with the electrical components of the electrical appliance, preferably through a third terminal mounted to the base of the power interlock switch. Therefore, when the two switch terminals are electrically connected, the appliance receives power through the line cord.

A leaf spring conductor is provided to bridge the two switch terminals. One end of the leaf spring conductor is preferably fixed to a first one of the switch terminals and the leaf spring conductor extends to adjacent and preferably past the second switch terminal, being spaced apart therefrom when the leaf spring conductor is in its free position. The leaf spring conductor may be deflected into contact with the second switch terminal, thereby providing a conductive path between the two switch terminals. A lever is pivotally mounted to the base of the power interlock switch, and includes a portion for engaging the leaf spring conductor and deflecting it into contact with the second switch terminal upon rotation of the lever. The lever includes a further portion which is engaged by a removable panel of the electrical appliance as the panel is placed in position, the engagement with the panel rotating the lever to close the power interlock switch. The lever is spring biased such that when the panel is removed, the lever rotates to permit the switch to open. The leaf spring conductor provides the spring bias for the lever in the preferred embodiment.

Also according to the invention herein, the power interlock switch is adapted for easy mounting through an opening in a metal wall of the housing of an appliance, the base of the power interlock switch being provided with a peripheral flange which bears against the metal wall surrounding the opening. The flange is embraced by a metal tab of the panel along one side of the opening, and the metal panel is provided with a twistable metal tab which is twisted to engage the peripheral flange opposite the embracing tab to hold the power interlock switch in place during assembly.

The power interlock switch is adapted to provide strain relief for the line cord of the appliance and to provide for quickly connecting the line cord to the appliance. Accordingly, two terminal tabs are provided on the base opposite its interior surface and the conductors of the line cord are provided with connector clips for quick attachment to the two terminal tabs. One of the terminal tabs is electrically connected to one of the switch terminals, and is preferably an integral portion thereof extending through the base. The other terminal tab is preferably a portion of the third terminal referred to above, the third terminal extending through the base of the power interlock switch for connection to a conductor completing a circuit through the electrical components of the appliance.

A cover is positioned over the exterior surface of the base and the line cord connections, and the cover clamps the conductors of the line cord to provide strain relief. More particularly, two spaced apart upstanding lugs are provided on the base and two offset upstanding lugs are also provided on the cover facing the base. The conductors of the line cord pass over the two sets of lugs, which combine to deform the conductors of the line cord in an S-shaped configuration and clamp the conductors between the lugs, thereby providing the strain relief. The cover also clamps the base to the housing wall.

Other and more specific features and objects of the invention will in part be obvious and will in part appear from a perusal of the description of the preferred embodiment and claims, taken together with the drawings.

DRAWINGS

The same reference numerals refer to the same elements throughout the various Figures.

DESCRIPTION OF PREFERRED EMBODIMENT

Figure 1:
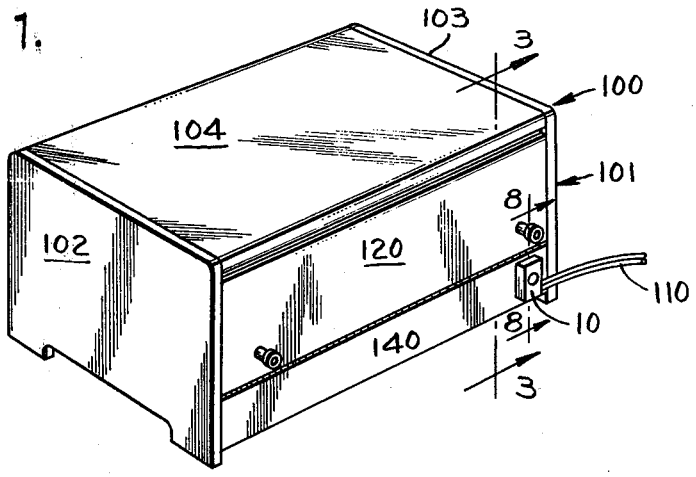
FIG. 1 is a perspective view of a power interlock switch according to the invention herein used in conjunction with a toaster/oven having a removable rear panel.

Referring now to FIG. 1, a preferred embodiment 10 of a power interlock switch according to the invention herein is used in conjunction with a toaster/oven 100. The power interlock switch 10 functions to cut off power supplied through a line cord 110 to the toaster-/oven 100 when a removable rear panel 120 is taken out to facilitate cleaning of the toaster/oven 100. The power interlock switch 10 is mounted on a fixed rear panel 140 of the toaster/oven 100, such that it is adjacent one edge of the removable panel 120. The power interlock switch 10 also functions to provide for quick connection of the two conductors of the line cord 110 to the toaster/oven 100, and further provides strain relief for the line cord 110.

The details of the construction of the power interlock switch 10 are best illustrated in FIGS. 3–8. The power interlock switch 10 generally comprises a base 15 having various terminals and switching components mounted thereto, a lever 60 for operating the switching components and a cover 70.

The base 15 includes a base plate 20 having integral sidewalls 21–24. An integral outwardly extending flange 25 surrounds the sidewalls 21–24 and is generally parallel to the base plate 20. In mounting the power interlock switch to the toaster/oven, the sidewalls 21–24 extend through a generally rectangular opening 142 in the fixed rear panel 140 and the flange 25 engages the fixed rear panel 140 on the marginal inside edge thereof surrounding the opening 142. The fixed rear panel 140 has a preformed offset tab 144 which loosely overlays the flange 25 adjacent sidewall 23, and the fixed rear panel 40 further has a T-shaped twist tab 146 disposed generally opposite the preformed offset tab 144. The T-shaped twist tab permits the base 15 of the power interlock switch 10 to be placed into the position shown, whereafter the T-shaped twist tab 146 is twisted to engage the flange 25 adjacent sidewall 21. The preformed offset tab 144 and the T-shaped twist tab 146 thereby hold the base 15 in position against the fixed rear panel 140 of the toaster/oven 100 during wiring, after which the cover 70 is added.

The base plate 20 mounts the terminals and switching components of the power interlock switch 10, generally on the "inside" surface 28 of the base plate which faces the interior of the toaster/oven. In particular, a first U-shaped terminal 30 has a base leg 31 mounted to the inside surface 28 of the base plate 20 by a rivet 32. A first terminal tab 33 extends outwardly from the base leg 31, and is adapted to receive a clip 151 of an insulated wire conductor 150 which conducts power from the power interlock switch 10 to the electrical components of the toaster/oven 100 (see the circuit diagram of FIG. 9). A second upstanding terminal tab 34 of the terminal 30 mounts a flexible leaf spring conductor 35. In particular, one end 36 of the leaf spring conductor 35 is fixed to the terminal tab 34, such as by soldering or welding, so that a conductive connection is established. The leaf spring conductor 35 extends from the terminal 30, and is generally straight when in its free position, shown in FIG. 4, but is deflectable as shown in FIG. 5 and discussed below.

Figure 4:
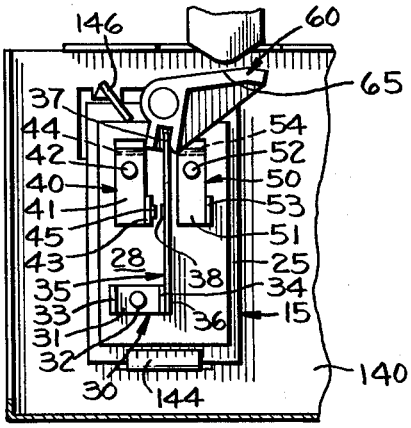
FIG. 4 is an elevation view of the inside surface of the power interlock switch in its open position.

A second terminal 40 includes a flat portion 41 which is attached to the inside surface 28 of base plate 20 by means of a rivet 42. The terminal 40 includes a first terminal tab 43 which extends outwardly from the inside surface of the base plate 20 adjacent the spring conductor 35, but spaced apart therefrom when the spring conductor is in its free position, as illustrated in FIG. 4. A second terminal tab 44 of the terminal 40 extends through an opening in the base plate 20 into the space surrounded by the sidewalls 21–24 of the base 15, the terminal tab 44 being adapted to receive a clip 111 for securing conductor 112 of the line cord 110 thereto.

The power interlock switch 10 further comprises the lever 60, which functions to deflect the leaf spring conductor 35 into contact with terminal tab 43 of terminal 40 when the removable rear panel 120 is in place on the back of the toaster/oven 100. The lever 60 is L-shaped and defines an opening 61 at the intersection of its legs. The opening 61 receives a cylindrical stud 58 integral with and extending outwardly from the base plate 20, wherein the lever 60 is pivotally mounted to the base 15. A first leg 62 of the lever 60 defines a slot 63 which captures the free end 37 of the leaf spring conductor 35. The leaf spring conductor 35 preferably extends well past the terminal tab 43, so that the engagement of its free end 37 with the lever 60 does not interfere with the contact between the leaf spring conductor and terminal tab 43. A central portion of the leaf spring conductor 35 contacts the terminal tab 43 when the leaf spring conductor 35 is deflected, and contact points 38 and 45 are provided on the leaf spring conductor and the terminal tab, respectively. The lever 60 is fabricated of non-conductive material.

Figure 5:
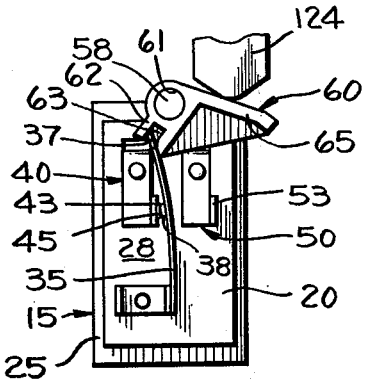
FIG. 5 is an elevation view of the inside surface of the power interlock switch in its closed position.

The other leg 65 of the lever 60 is positioned to be engaged by the removable rear panel 120 of the toaster-/oven 100 as the removable rear panel 120 is installed, the engagement between the rear panel 120 and the leg 65 rotating the lever 60 to deflect the leaf spring conductor 35 into contact with the tab 43 of terminal 40, as seen in FIG. 5. Specifically, the contact points 38 and 45 are urged together, and the power interlock switch 10 is closed to provide a conductive path from line cord conductor 112 through terminal 40, leaf spring conductor 35, terminal 30 and conductor 150 to the electrical components of the toaster/oven 100. The contact points 38 and 45 are vertically oriented to avoid catching debris which would block contact.

A third terminal 50 is mounted to the base 20 spaced apart from the other terminals 30 and 40, and terminal 50 comprises a flat portion 51 secured to the base plate 20 by a rivet 52. The terminal 50 comprises a first terminal tab 53 which extends outwardly from the inside surface 28 of the base plate 20, and is adapted to receive a clip 156 for attaching a second wire 155 to complete a power circuit to the electrical components of the toaster/oven (see FIG. 9). A second terminal tab 54 extends through the base plate 20 into the area surrounded by the sidewalls 21–24, for receiving a clip 113 of the second conductor 114 of the line cord 110.

Figure 6:
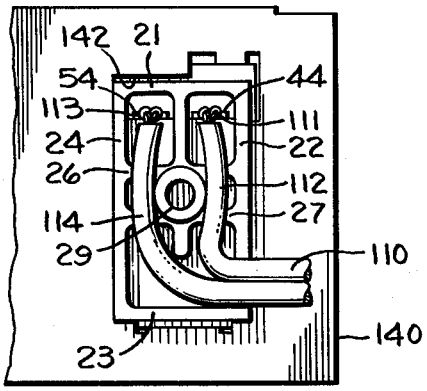
FIG. 6 is an elevation view of the outside surface of the base of power interlock switch with the cover removed.

The power interlock switch 10 further comprises its cover 70, and the cover 70 in conjunction with the base 15 provides strain relief for the power cord 110 by clamping it therebetween. In order to accomplish the strain relief function in an advantageous manner, the base plate 20 is provided with two parallel spaced apart clamping lugs 26 and 27 which extend across the base plate 20 between the sidewalls 22 and 24, as best seen in FIG. 6. A cylindrical screw receptacle 29 is also provided on the base plate 20 and the screw receptacle 29 may intersect the walls 27 and 28. The line cord 110 passes over the sidewall 22 of the base plate 20 and splits into its two individual wire conductors 112 and 114, which extend across the two clamping lugs 26 and 27. Wire conductor 112 is connected by clip 111 to tab 44 of terminal 40, and wire conductor 114 is connected by clip 113 to tab 54 of terminal 50.

Figure 7:
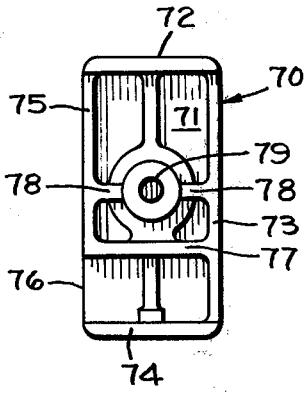
FIG. 7 is an elevation view of the inside of the cover of the power interlock switch.
Figure 8:
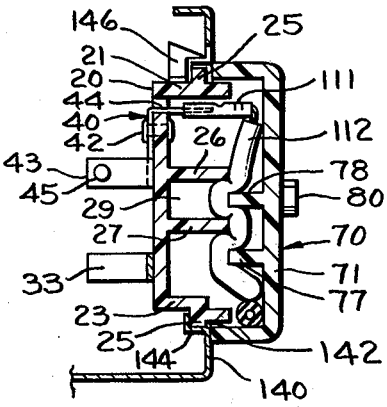
FIG. 8 is a sectional view taken along the lines 8—8 of FIG. 1 of the power interlock switch showing the strain relief function thereof.

The cover 70 of the power interlock switch 10, illustrated in FIG. 7, comprises a cover plate 71 having sidewalls 72–75 upstanding therefrom, the sidewall 75 extending less than the full length of the cover plate 71 to provide an entrance slot 76 for the line cord 110. The cover 70 further comprises two clamping lugs 77 and 78 which are parallel, spaced apart, and extend between the sidewalls 73 and 75. The cover 70 further comprises an opening 79 for accommodating a screw 80 which holds the cover 70 to the base 15, the opening 79 also intersecting the clamping lug 78. With reference to FIG. 8, when the cover is assembled to the base 15, the clamping lugs 26 and 27 of the base plate 20 and the clamping lugs 77 and 78 of the cover 70 deform the wire conductors 112 and 114 of the line cord 110 into a generally S-shaped tortuous path and clamp the wire conductors 112 and 114 therebetween. Therefore, any strain on the line cord 110, or more specifically on the wire conductors 112 and 114 thereof, is absorbed at the cooperating clamping lugs of the cover and base, and is not imparted to the terminals or terminal clips. The cover 70 is secured to the base 15 by means of a screw 80 which passes through the opening 79 in the cover 70 and is received in the screw receptacle 29 of the base plate 20.

The cover 70 also clamps the base 15 to the panel 140, and in particular, the panel 140 is embraced between the peripheral flange 25 of the base and the sidewalls 72 and 74 of the cover 70. This rigidly mounts the power interlock switch 10 to the toaster/oven 100.

Figure 3:
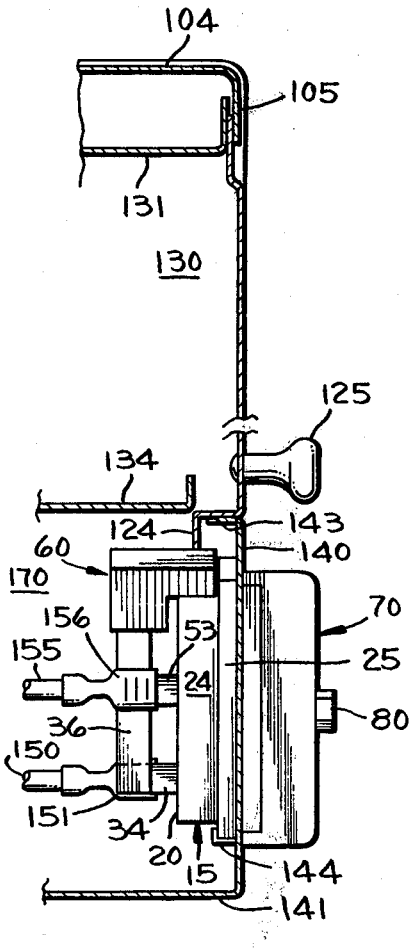
FIG. 3 is a sectional view of the toaster/oven taken along the lines 3—3 of FIG. 1 and showing the engagement of the rear panel with the power interlock switch.
Figure 2:
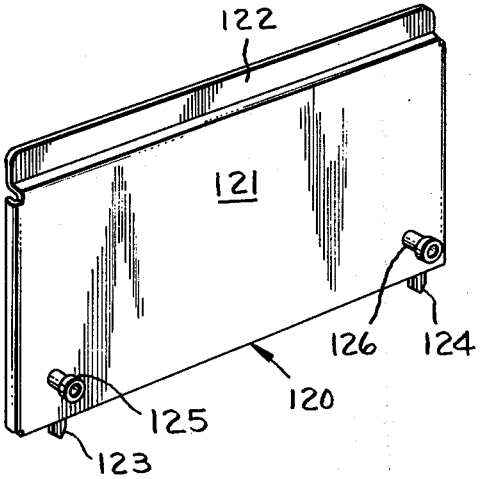
FIG. 2 is a perspective view of the rear panel of the toaster/oven of FIG. 1.

With reference to FIGS. 1–3, the toaster/oven 100 has a housing 101 most generally comprised of end panels 102 and 103 connected by a top panel 104 and a fixed rear panel 140. The fixed rear panel 140 is preferably integral with a bottom panel 141, these two panels being fabricated of a single sheet of stamped metal. A cooking chamber 130 is defined within the housing by a cooking chamber top panel 131, adjacent the housing top panel 104, and a cooking chamber bottom panel 134, which is parallel and spaced above the housing bottom panel 141. A door, not shown, is mounted to close the front of the cooking chamber.

The removable rear panel 120 is positioned to close the back of the cooking chamber 130. As best seen in FIGS. 2 and 3, the removable rear panel 120 comprises a main portion 121, and has an offset flange 122 at the top thereof. Two offset spaced apart tabs 123 and 124 are provided at the bottom of the removable rear panel 120, and two handles 125 and 126 are provided to assist in maneuvering the removable rear panel for installation and removal. With particular reference to FIG. 3, the top panel 104 includes a downturned flange 105 forming a small portion of the back of the toaster/oven, and a slot for the offset flange 122 of the removable rear panel 120 is defined between the downturned flange 105 and the cooking chamber top panel 131. The fixed rear panel 140 includes an inturned flange 143, on which the offset portions of the tabs 123 and 124 rest. The downwardly extending portions of the tabs 123 and 124 are received in slots in the flange 141 to achieve laterally positioning of the removable rear panel 120 as it is installed.

It will be appreciated from FIGS. 1 and 3 that the removable rear panel 120 can be removed from the toaster/oven 100 by grasping the handles 125 and 126, sliding the removable rear panel 120 upwardly to release the tabs 123 and 124, and then pivoting the panel outwardly. The removable rear panel 120 is then pulled downwardly to release and remove the offset flange 122. The removable rear panel 120 is replaced by reversing the procedure.

With reference to FIGS. 4 and 5, as the removable rear panel 120 is being installed in the toaster/oven 100, the tab 124 contacts the second leg 65 of the lever 60, and rotates the lever to the position shown in FIG. 5 with the contact point 38 of leaf spring conductor 35 pressed against the contact point 45 of the terminal tab 43. Power is thus supplied to the toaster/oven from the line cord. The flexibility of the leaf spring conductor 35 is such that its free end 37 can continue to deflect after the leaf spring conductor 35 has made contact with the terminal tab 43, providing a certain resiliency to the structure and avoiding the need for any critical switch travel in order to make contact. When the rear panel 120 is removed, the tab 124 is moved out of contact with the leg 65 of the lever 60, and the flexible leaf spring conductor 35 rotates the lever 60 to the position shown in FIG. 4, breaking contact with the terminal tab 43 and cutting off power to the electrical components of the toaster/oven 100.

Figure 9:
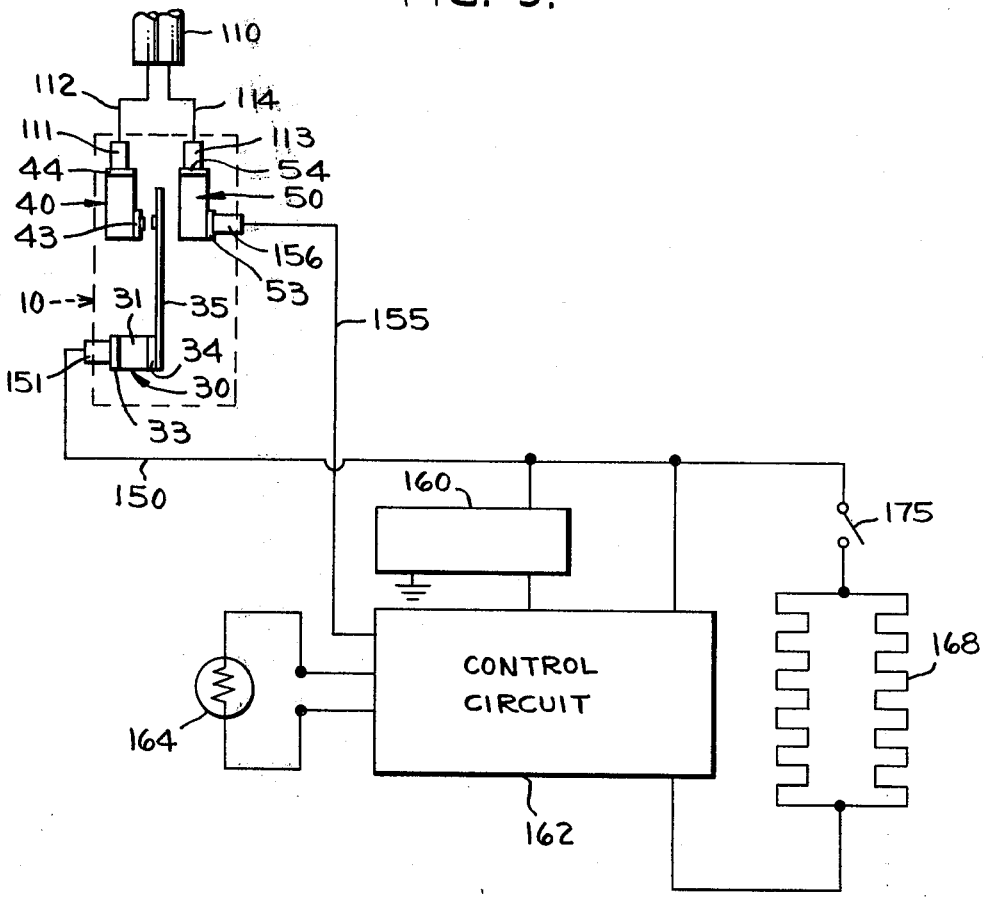
FIG. 9 is a schematic circuit diagram for the toaster-/oven of FIG. 1.

A schematic diagram of the electrical components of the toaster/oven is shown in FIG. 9. Briefly, they include a DC power supply 160, control circuit 162 having timers, thermostats, switches, etc., a temperature sensor 164 positioned in the cooking chamber, and heating elements 168 also positioned in the cooking chamber. The DC power supply and control circuit components are preferably located in a chamber 170 defined between the cooking chamber bottom panel 134 and the housing bottom panel 141. A front door switch 175 opens the circuit through the heating elements 168 when the front door of the toaster/oven is opened, for safety reasons. Thus, the heating elements 168 can have power and operate if both the power interlock switch 10 and the door switch 175 are closed, and the DC power supply 160 and control circuit 162 can draw power and operate if the power interlock switch 10 alone is closed.

Therefore, even though the toaster/oven may be provided with a door switch 175 which cuts off power to the heating elements 168 when the door is open, this does not obviate the need for a power interlock switch. It is entirely possible that the door would remain closed and the door switch also remain closed when the rear panel 120 was removed. The power interlock switch 10 provides for the desired cut off of power under this circumstance. Further, by mounting the power interlock switch to the rear panel 140 and integral bottom panel 141, removal of this panel (which is typically secured in its fixed position by screws) for servicing the electrical components in the chamber 170 also destroys the engagement between the rear panel 120 and the lever 60 of the power interlock switch 10, breaking the supply of power to the toaster/oven 100.

The power interlock switch 10 admirably achieves the objects of the invention herein, and is advantageously used with a toaster/oven. The power interlock switch 10 can also be used with other electrical appliances with the same benefits. It will be appreciated that the above disclosure of a preferred embodiment is illustrative only and that various changes can be made without departing from the spirit and scope of the invention, which is limited only by the following claims.

I claim:

1. A power interlock switch for an appliance having a removable panel, a nonconductive base mounted to and disposed inside the appliance, electrical components and a line cord for supplying electrical power to the appliance, the power interlock switch comprising:

(A) a first switch terminal mounted to the nonconductive base;

(B) a second switch terminal mounted to the nonconductive base and spaced apart from the first switch terminal;

(C) a leaf spring conductor mounted to the first switch terminal and extending therefrom to adjacent the second switch terminal, the leaf spring conductor being deflectable into contact with the second switch terminal to establish a conductive path between the first and second switch terminals;

(D) a lever pivotally mounted to the nonconductive base and rotatable to engage the leaf spring conductor and deflect it into contact with the second switch terminal, the lever positioned to be engaged and rotated by the removable panel when the removable panel is in position on the appliance;

wherein one conductor of the line cord is connected to the electrical components of the appliance and the other conductor of the line cord is connected to one of the switch terminals and the other switch terminal is connected to the electrical components of the appliance, whereby contact of the leaf spring conductor with the second switch terminal completes an electrical circuit through the electrical components of the appliance, and wherein removal of the removable panel disengages the removable panel from the lever and permits the leaf spring conductor to move out of contact with the second switch terminal, thereby breaking the electrical circuit through the electrical components of the appliance.

2. A power interlock switch as defined in claim 1 wherein the free end of the leaf spring conductor is positioned past the second switch terminal and the lever engages the leaf spring conductor at a point past the second switch terminal, whereby the leaf spring conductor may be further deflected after the leaf spring conductor contacts the second switch terminal and thereby provides resiliency absorbing rotational motion of the lever beyond that required to close the power interlock switch.

3. A power interlock switch as defined in claim 2 wherein the lever defines a slot which receives the free end of the leaf spring conductor.

4. A power interlock switch as defined in claim 3 wherein the lever is L-shaped, one leg of the L-shaped lever defining the slot receiving the free end of the leaf spring conductor and the other leg of the L-shaped lever engaging the removable panel of the appliance.

5. A power interlock switch as defined in claim 2 wherein the second switch terminal has a contact point mounted thereon and the leaf spring conductor has a contact point mounted thereon and positioned such that the contact points are urged together upon deflection of the leaf spring conductor to close the power interlock switch.

6. A power interlock switch as defined in claim 5 wherein the contacting surfaces of the contact points are oriented vertically to avoid catching debris, such as food particles, which would prohibit closing of the power interlock switch.

7. A power interlock switch as defined in claim 1 wherein the base comprises a base plate having an inside surface disposed interiorly of the electrical appliance and an outside surface exposed to the exterior of the appliance through an opening in a panel of the appliance to which the base plate is mounted, the first and second switch terminals including terminal tabs upstanding from the inside surface of the base plate, the leaf spring conductor being positioned adjacent the inside surface of the base plate and the conductor of the line cord connected to one of the switch terminals being connected through the base plate.

8. A power interlock switch as defined in claim 7 wherein the switch terminal to which one conductor of the line cord is attached includes a terminal tab extending through the base plate, the conductor of the line cord having a terminal clip for connecting it to the terminal tab adjacent the outside surface of the base plate, and wherein the power interlock switch further comprises:

a third terminal mounted to the base; the third terminal having a terminal tab extending through the base, the second conductor of the line cord having a terminal clip for connecting it to the terminal tab of the third terminal adjacent the outside surface of the base plate, said third terminal being connected to the electrical components of the appliance to complete a circuit therethrough.

9. A power interlock switch as defined in claim 8 wherein the other switch terminal to which the electrical components of the appliance are connected includes a terminal tab upstanding from the interior surface of the base plate and adapted to receive a clip of a wire conductor for electrically connecting the switch terminal to the electrical components of the appliance and said third terminal includes a second terminal tab upstanding from the inside surface of the base plate and adapted to receive a clip of another wire connector completing the circuit through the electrical components of the appliance.

10. A power interlock switch as defined in claim 7 wherein the base plate includes a peripheral flange which engages the marginal edges of the opening in the appliance through which the base plate is mounted, the flange being adapted to be engaged by offset tabs of the appliance to secure the base plate in position thereon.

11. A power interlock switch as defined in claim 8 and further comprising:

a cover secured over the outside surface of the base plate, said cover thereby shielding the attachment of the terminal clips of the line conductor to the terminal tab of the switch and third terminal.

12. A power interlock switch as defined in claim 11 wherein the cover clamps the conductors of the line cord between the cover and the base plate, thereby providing strain relief for the line cord.

13. A power interlock switch as defined in claim 12 wherein the base plate is provided with the two spaced apart parallel clamping lugs upstanding from the outside surface thereof and the cover includes two spaced apart parallel clamping lugs extending toward the outside surface of the base plate, the clamping lugs of the cover and base plate being offset when the cover is positioned over the base plate whereby the clamping lugs deform the wire conductors of the line cord into generally S-shaped paths and clamp the wire conductors therebetween.

14. A power interlock switch for an appliance having a removable panel, electrical components and a line cord for supplying electrical power to the appliance, the power interlock switch comprising:

(A) a base fabricated of non-conductive material and adapted for mounting to a wall of the appliance juxtaposed an opening in the appliance wall, the base including a base plate having an inside surface disposed interiorly the appliance and an outside surface exposed through the opening in the appliance wall;

(B) a first switch terminal mounted to the base plate and having a first terminal tab upstanding from the inside surface of the base plate and a second terminal tab extending through the base plate and exposed adjacent the outside surface of the base for connection to one conductor of the appliance line cord;

(C) a second switch terminal mounted to the base plate and having a first terminal tab upstanding from the inside surface of the base plate, the second switch terminal being adapted to be electrically connected to the electrical components of the appliance;

(D) a leaf spring conductor having one end thereof mounted to the first terminal tab of one of the first and second switch terminals, having an intermediate portion positioned adjacent the first terminal tab of the other of the first and second switch terminals whereby the leaf spring conductor extends past that terminal tab to its free end, the leaf spring conductor being deflectable into contact with that terminal tab to establish a conductive path between the first and second switch terminals;

(E) an L-shaped lever pivotally mounted to the base, one leg of the L-shaped lever engaging the free end of the leaf spring conductor and the second leg engaging the removable panel of the appliance such that the lever rotates to deflect the leaf spring conductor and establish a conductive path between the first and second switch terminals when the removable panel is in place;

(F) a third terminal mounted to the base plate and having a terminal tab extending through the base plate and exposed adjacent the outside surface of the base plate for connection to the other conductor of the line cord, the third terminal also adapted for connection with the electrical components of the appliance to complete the circuit therethrough; and (G) a cover secured over the outside surface of the base plate and shielding the connection of the line cord to the terminal tabs and clamping the line cord to the base for providing strain relief to the line cord.

15. A power interlock switch as defined in claim 14 wherein the base plate is provided with the two spaced apart parallel clamping lugs upstanding from the outside surface thereof and the cover includes two spaced apart parallel clamping lugs extending toward the outside surface of the base plate, the clamping lugs of the cover and base plate being offset when the cover is positioned over the base plate whereby the clamping lugs deform the wire conductors of the line cord into generally S-shaped paths and clamp the wire conductors therebetween.

* * * * *